United States Patent [19]

Pellegrino

[11] Patent Number: 4,724,609

[45] Date of Patent: Feb. 16, 1988

[54] APPARATUS FOR IMPROVED HARNESS MANUFACTURE

[75] Inventor: Thomas Pellegrino, Lisle, Ill.

[73] Assignee: Molex Incorporated, Lisle, Ill.

[21] Appl. No.: 11,387

[22] Filed: Feb. 5, 1987

Related U.S. Application Data

[62] Division of Ser. No. 778,093, Sep. 20, 1985, abandoned.

[51] Int. Cl.[4] ..... H01R 43/04

[52] U.S. Cl. ..... 29/753; 29/759

[58] Field of Search ..... 29/753, 759, 751, 747, 29/566.3, 566.4; 72/409, 410

[56] References Cited

U.S. PATENT DOCUMENTS 4,184,244 1/1980 Kaczmarek ..... 29/751 X 4,227,299 10/1980 Kuehling ..... 29/751

4,534,107 8/1985 Maack ..... 29/751

*Primary Examiner*—Carl E. Hall

*Attorney, Agent, or Firm*—John W. Cornell; Louis A. Hecht

[57] ABSTRACT

An improved apparatus for terminating single conductors to an electrical connector having two rows of terminals, one on top of the other. The rows are staggered so that the terminals of one row are located between the terminals of the other row. An improved terminator is used to terminate wires to both upper and lower connector rows with an actuator of constant predetermined downward deflection.

The apparatus also includes an improved index means for advancing a succession of terminals to a termination station.

5 Claims, 6 Drawing Figures

APPARATUS FOR IMPROVED HARNESS MANUFACTURE

This application is a division of application Ser. No. 778,093 filed Sept. 20, 1985 now abandoned.

BACKGROUND OF THE INVENTION

1. Field of the Invention

The present invention relates to apparatus for assembling wires into electrical connectors to form wire harnesses. In particular, the present invention relates to semi-automatic bench termination equipment for such assembly.

2. Description of the Prior Art

Several arrangements have been disclosed for forming electrical harnesses of the type consisting of an electrical connector terminated to a plurality of wires of either the discrete or flat cable type. Various improvements have been made to such apparatus, as well as to the connectors and cables employed in making the harnesses. Commonly owned U.S. patent application Ser. No. 698,504 filed Feb. 4, 1985 discloses an improved electrical connector, adapted for mass termination to a plurality of wires. The connector has two rows of terminals placed one on top of the other in a staggered configuration, so as to allow all of the terminals to be mass terminated from a top surface of the connector. The connector also includes an opposed bottom surface having two series of recesses, aligned with the two rows of terminals.

When smaller quantities of electrical harnesses are needed on short notice, fully automatic termination equipment may not be suitable to meet the demand. Accordingly, bench termination equipment is typically provided to form electrical harnesses in these situations. Equipment of this type is intended for small production runs, in that it is less efficient than fully automatic machines, being more labor intensive. Typically, an operator is required to carry out each harness making cycle.

One typical arrangement provided by the owner of the present invention is designated the CAM III machine, a semi-automatic harness making apparatus. In this machine, the operator inserts a discrete wire for each terminal of the electrical connector. The machine feeds a serial succession of connectors before the operator who inserts a wire conductor above the first terminal presented, and operates a switch initiating the termination cycle for a given connector. The machine automatically indexes the connector presenting the next terminal to the operator for a successive termination cycle. Arrangements of this type are not suitable for dual row connectors, in that two termination assemblies must be provided, one for each row.

An example of a machine that does provide single-step mass termination for a dual-row staggered connector is described in U.S. Pat. No. 4,091,531 issued May 30, 1978. In that arrangement, an arbor press is provided having a lower stationary tool head, and an opposed upper moveable tool head. A connector having dual-row staggered wire receiving portions is loaded in the upper moveable head. A series of plates having particularly configured upper serrated edges are stacked together in an array which is mounted in the lower tool head. The blades provide terminal supporting, wire inserting, and wire guiding functions. A plurality of discrete wires are then fed between the upper and lower tool heads, and the upper head is lowered, so as to compress the wire between the connector, and the upper edges of the plate array. This machine is adapted for use with a connector having relatively open, unsupported wire receiving portions. It cannot be used with connectors having fully enclosed wire receiving portions, which offer significant advantages in supporting and protecting the terminals received therein.

Another termination apparatus is disclosed in commonly owned Great Britian Patent application No. 8,412,827 filed May 18 1984. The apparatus disclosed is of the wire stitcher type, wherein discrete wires are terminated one at time to a multi-terminal connector. The apparatus includes a single wire feed and terminator head. The connector to which the patent application is directed has two rows of wire receiving terminals, which are staggered in two different directions. The machine includes an indexing table for indexing a connector nest in three mutually orthogonal directions, so as to present a serial succession of terminals at a fixed position beneath the terminator blade. The indexing table for this type of apparatus is complex and somewhat costly, particularly if the wire receiving terminal portions are staggered in only one direction.

SUMMARY OF THE INVENTION

Accordingly, it is an object of the present invention to provide an apparatus for terminating multiple wires to a dual-row staggered connector.

It is another object of the present invention to provide an apparatus for terminating wires in a dual-row connector, having upper and lower rows of staggered terminals, with a single wire terminator having a constant insertion stroke. This object is provided in a machine for the manufacture of electrical cable harnesses including at least one insulation-clad wire electrically terminated in a connector including a housing having at least one terminal receiving cavity with an insulation displacing terminal mounted therein, the machine including a terminator adjacent the connector having a reciprocating actuator extensible a constant predetermined amount, and at least one wire insertion blade mounted to the actuator to travel a predetermined termination stroke toward the connector so as to insert a wire in the terminal thereof, and a connector support surface for supporting said connector during termination, predeterminedly spaced from said actuator. The improvement comprises a pressure limit means between the actuator and blade which automatically limits the insertion force applied by the insertion blade, to a predetermined terminating force independent of the termination stroke, whereby the machine can automatically terminate a series of different connector arrangements requiring different termination strokes equal to or less than said predetermined stroke.

Still another object of the present invention is to provide an improved apparatus for indexing a connector to present successive terminals to a termination station. This object of the present invention is provided in a machine for the manufacture of electrical cable harnesses including an insulation-clad wire terminated in a connector having a housing with at least one terminal receiving cavity and an insulation displacing terminal mounted therein, and a bottom surface with a series of recesses formed therein, an indexing means cooperating with the housing recesses is provided for indexing the connector in a forward direction to present the terminals of the connector one at a time to a termination station. The improvement includes said indexing means wherein said connector bottom surface having at least two parallel spaced-apart series of recesses extending in the forward direction and staggered with respect to each other in the forward direction, said recesses aligned with said terminals in a predetermined orientation. The improvement comprises at least two spaced-apart indexing pawl means rotatably mounted to a reciprocating drive member movable in the forward direction, each pawl means associated with a particular series of recesses, and said pawl means alternately engageable and disengageable with the recesses of its respective series in response to movement of said drive member, such that only one pawl means is engaged with a recess at any one time, whereby upon movement of said drive means, said connector is displaced predetermined amounts in the forward direction to present a succession of terminals to the termination station.

BRIEF DESCRIPTION OF THE DRAWINGS

In the drawings, wherein like elements are referenced alike.

DETAILED DESCRIPTION OF THE PREFERRED EMBODIMENT

Figure 1:
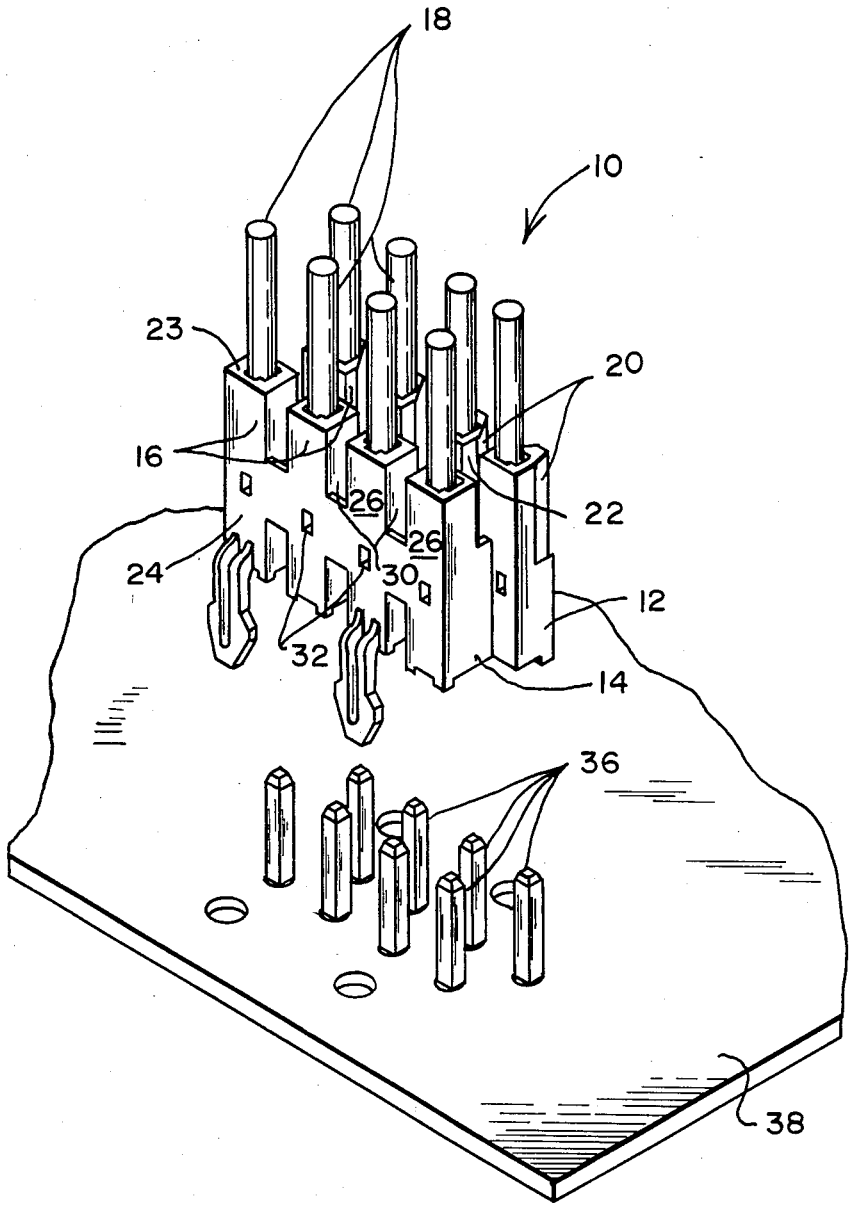
FIG. 1 is a perspective view of a dual-row staggered connector for use with the present invention.

FIG. 1 shows a dual-row staggered connector disclosed in a commonly owned U.S. patent application Ser. No. 698,504 filed Feb. 4, 1985. The connector, generally indicated at 10, includes upper and lower rows of terminal receiving cavities 12, 14 each having a plurality of terminal receiving cavities 16 with insulation displacement type terminals therein, not visible in this figure.

In the particular embodiment of connector 10 shown in FIG. 1, the connector has pin-receiving terminals designed to mate with pins 36 secured to a printed circuit board 38. A plurality of discrete insulation clad wires 18 are shown terminated to each terminal of connector 10.

Rows 12, 14 are arranged one on top of the other, in a staggered configuration wherein the terminal receiving cavities of one row are positioned between the terminal receiving cavity of the other row. Further, the terminal receiving cavities 16 of the upper row include sidewalls 20 forming wire receiving channels 22 guiding wires to be terminated in the lower row 14. All of the wires 18 can be terminated to both rows 12, 14 from a single upper side of the housing. Connector 10 has a mating end not visible in the figure, and an opposed wire receiving end 23.

The bottom surface 24 of connector 10, visible in FIG. 1, comprises the bottom cavity walls 26 positioned between the sidewalls 20 of each lower row terminal receiving cavity. Also, shown in the bottom surface of connector 10, are two series of recesses 30, 32 aligned with the center line progression of top and bottom rows 12, 14 respectively. Recesses 30 lie beneath the terminal receiving cavities of upper row 12, and are formed between adjacent terminal receiving cavities 16 of lower row 14. As will be explained herein, recesses 30, 32 are employed in the improved connector indexing arrangement of the present invention.

Figure 2:
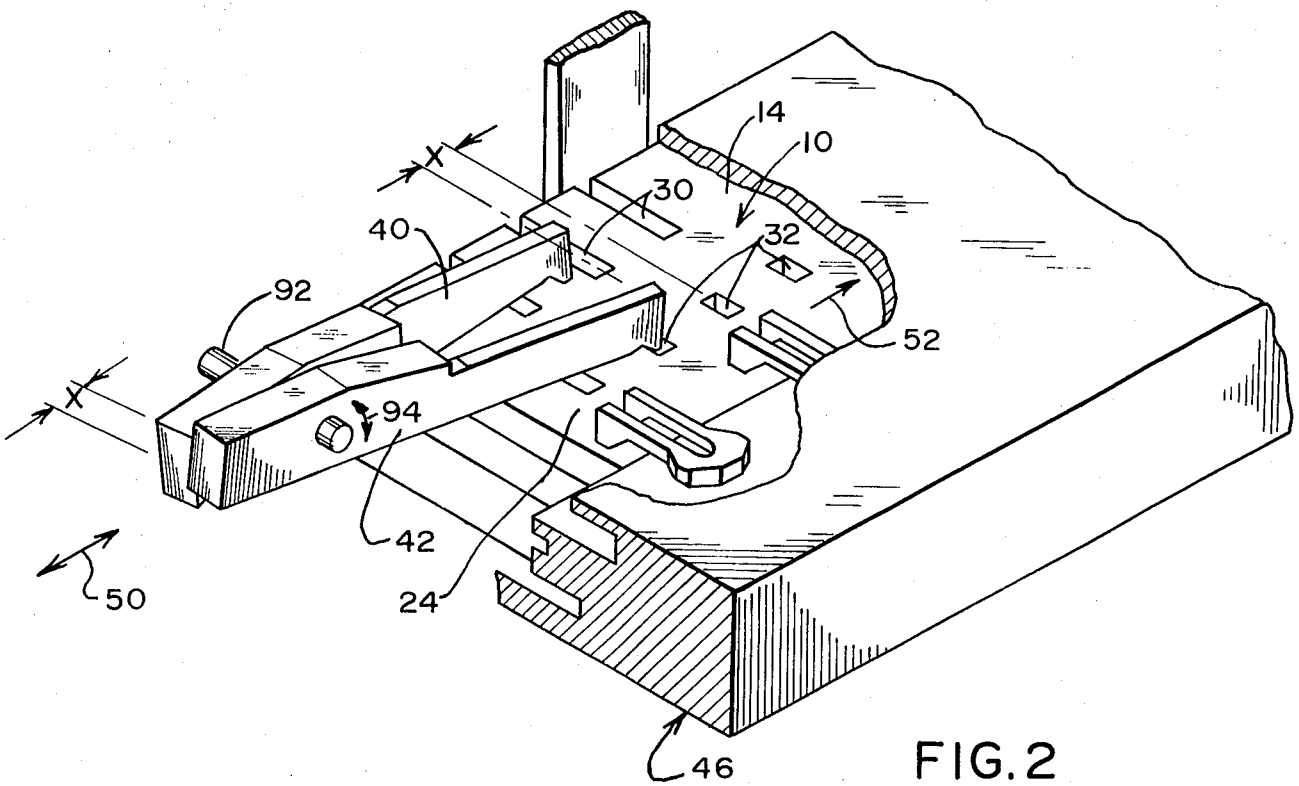
FIG. 2 is a perspective view illustrating the connector indexing technique of the present invention.

Referring now to FIG. 2, the indexing arrangement of the present invention is illustrated with a pair of pawl means 40, 42 which are joined together for simultaneous back and forth movement in the directions of arrow 50. The tip of pawl 40 is received in the recesses 30 of connector 10, and pawl 42 is received in recesses 32. The view of FIG. 2 is taken from the underside of the machine of the present invention, for purposes of illustration. Accordingly, connector 10 is shown upside-down, being slid along a guide track 46 with an incremental motion (see displacement "x" below) provided by pawls 40, 42.

In the preferred embodiment, recesses 30, 32 are aligned with the progression of upper and lower terminal rows. The offset distance between terminal rows is designated by the letter "x". Pawls 40, 42 are oscillated back and forth in the directions of arrow 50 in an amount equal to the displacement "x". As will be described herein, pawls 40, 42 are spring loaded and pivotally mounted, so as to be readily engaged and disengaged from the series of recesses which they track, to provide a "walking" motion of connector 10, in the direction of arrow 52.

Figure 3:
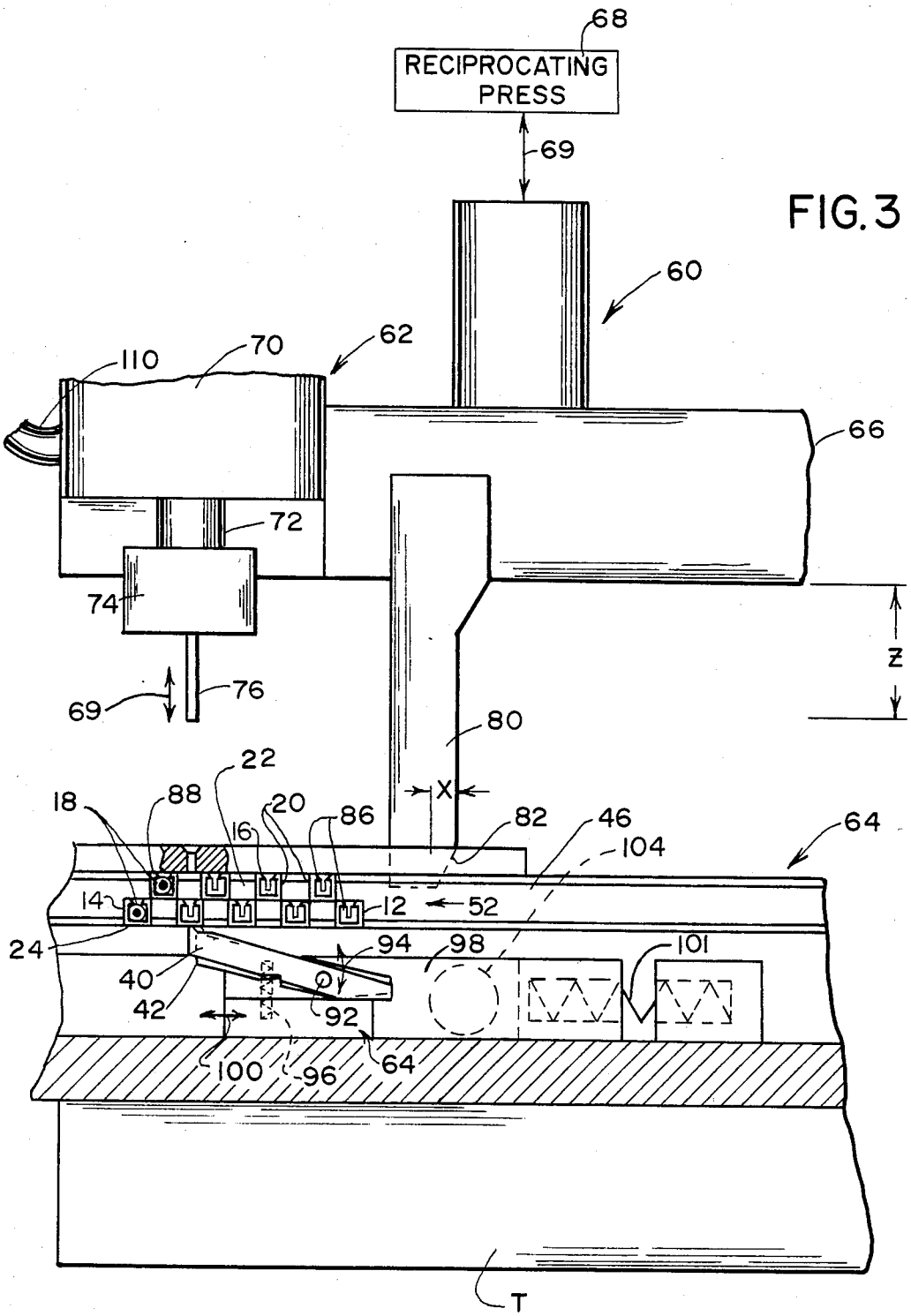
FIG. 3 is a front view of a termination machine showing the improved terminator and connector indexing features of the present invention.

Referring now to FIG. 3, terminating machine 60 according to the present invention is shown comprising upper and lower tooling assemblies 62, 64, respectively. Lower tooling assembly 64 is mounted on a support table T or other supporting surface. Upper tooling portion 62 is mounted on an upper die assembly 66 of a reciprocating press 68, such as that commonly found in bench-type crimp terminator machines. Press 68 reciprocates upper tooling head 66 in the vertical directions of arrow 69, with a constant displacement stroke indicated by the letter "z".

Tooling portion 62 comprises a pnuematic piston or cylinder 70, having a moveable piston rod 72. A compressed air line 110 is provided for operation of the piston. A mounting block 74, in turn, connected to the lower free end of piston rod 72. A conventional wire insertion blade 76 is secured in mounting block 74 to engage and insert wires 18 in connector terminals 86 which are visible in side view in FIG. 3 (which shows the wire engaging end wall 23 of connector 10).

Also mounted to upper die 66 is an elongated indexing blade 80 having a lower cam surface 82. Blade 80, securely attached to upper die assembly 66, travels the full extent of displacement "z". However, as will be explained herein, wire insertion blade 76, under the selectively collapsible action of piston 70, can travel the full distance "z", or any fraction thereof, in an insertion stroke of predetermined desired length.

Also shown in FIG. 3, are pawls 40, 42 and their common mounting pin 92, about which they pivot in the direction of arrow 94. Pawls 40, 42 are biased in an upward direction by compression spring 96, which urges the pawl tips upwardly toward their respective recesses 30, 32. Pawls 40, 42 are pinned to a sliding mounting rail 98 by pin 92, for reciprocal movement in the direction of double-headed arrow 100. Rail 98 is biased for movement in the direction of arrow 52, by compression spring 101.

Figure 4:
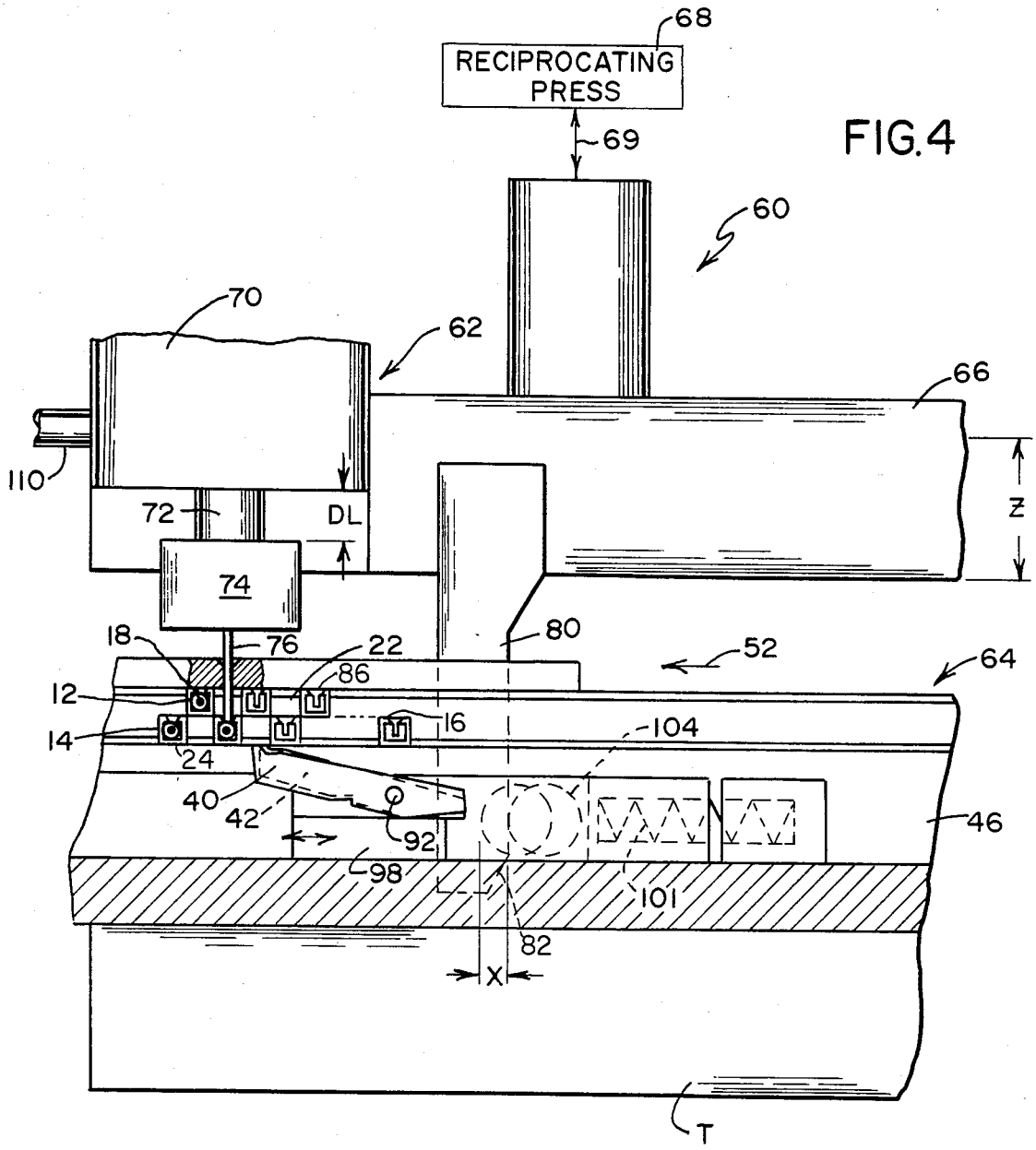
FIG. 4 shows the machine of FIG. 3 terminating a wire in a lower connector row.
Figure 5:
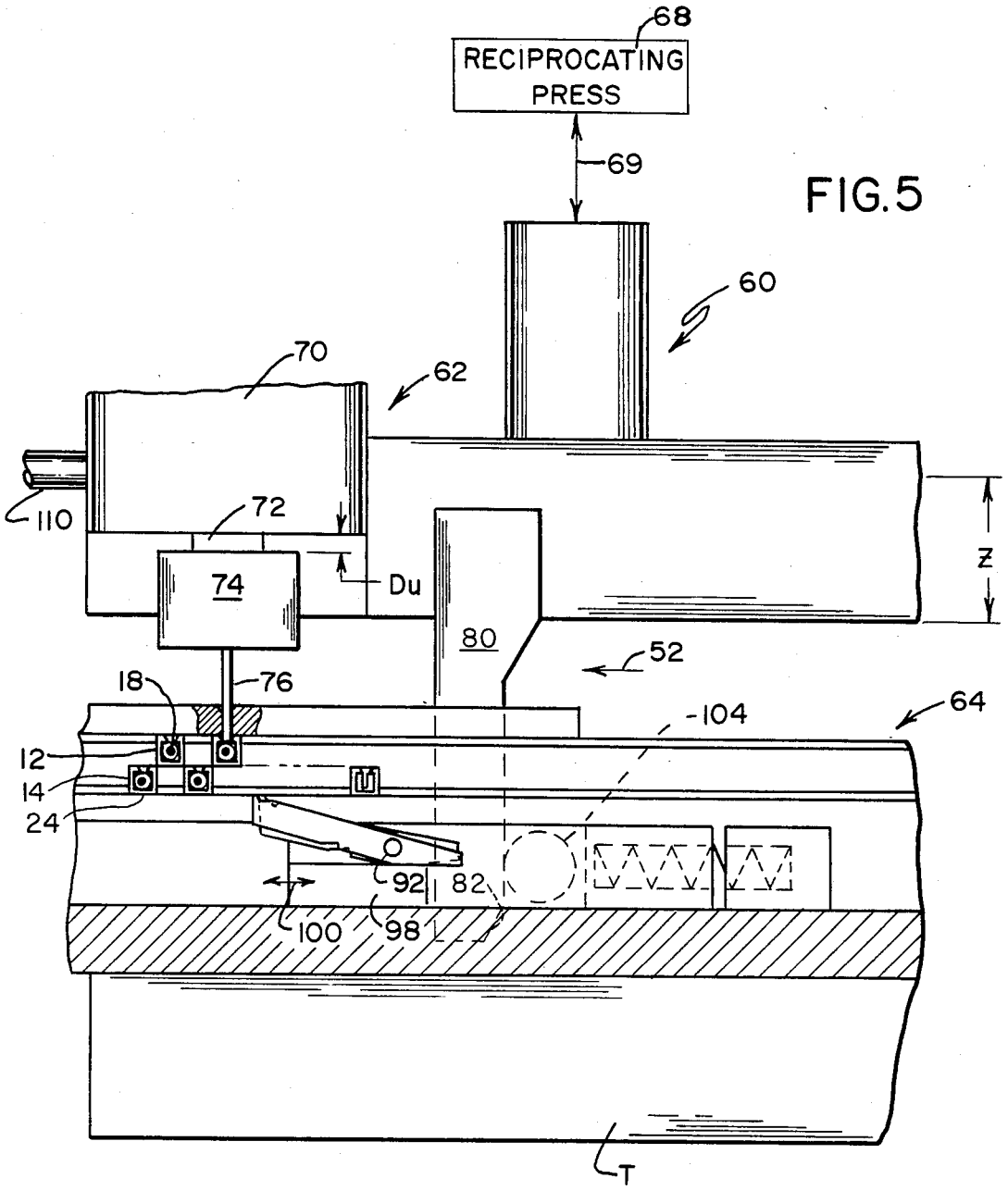
FIG. 5 shows the machine of FIGS. 3 and 4 terminating a wire in an upper connector row.
Figure 6:
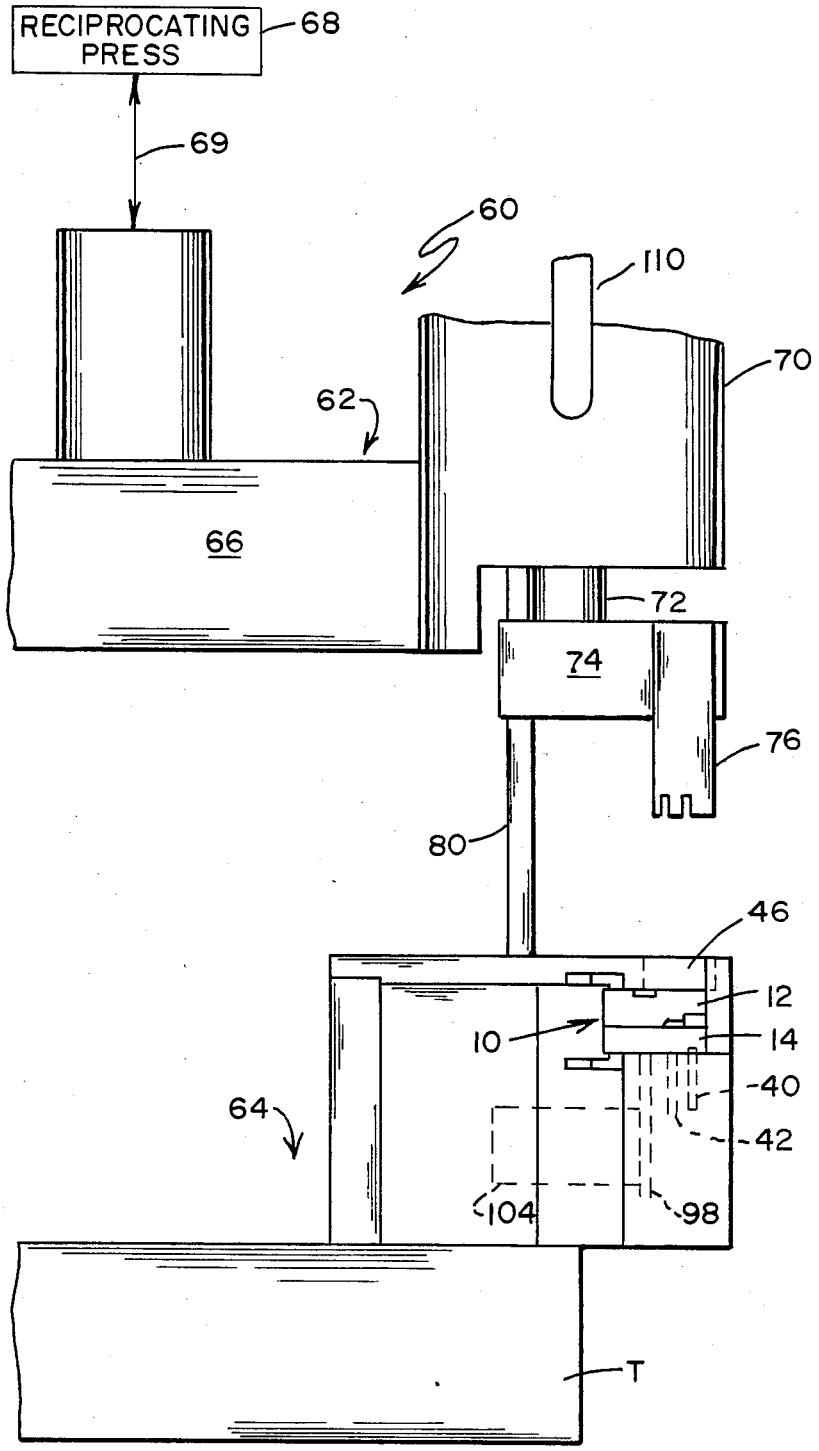
FIG. 6 is a side view of the machine of FIGS. 3–5.

In FIG. 3, upper tooling portion 62 is shown in its uppermost position, with blade 80 thereof clearing a rounded drive peg 104, rigidly fastened to rail 98. As shown in FIGS. 4 and 5, upper tooling portion 62 is depressed to its lowermost position, having travelled its constant displacement "Z", with blade 80 engaging drive peg 104, thereby displacing the drive peg, and rail 98, an incremental distance "x" opposite that of arrow 52. Upon this movement, pawls 40, 42 are advanced in a direction opposite that of arrow 52, with the pawl tip of member 40 becoming disengaged from its recess 30 (thereby pressing against surface 24), and with the pawl tip of member 42 engaging the adjacent upstream recess 32. At this point, connector 10 has not yet been indexed. However, upon subsequent retraction of upper tooling portion 62, with blade 80 upwardly disengaging drive peg 104, the drive peg and the moving plate 98 attached thereto are free to move a distance "x" in the direction of arrow 52, under the force of spring 101, thereby indexing connector 10. Only one pawl lip is engaged in a recess at any one time.

Upper tooling portion 62 is secured to upper die 66, always travelling the constant vertical displacement "z". FIG. 4, shows a termination stroke wherein a wire 18 is terminated to lower row 14, connector 10 having been indexed to present a terminal-receiving cavity 16 of lower row 14 beneath termination blade 76. An operator positions a wire 18 immediately above the terminal of the lower row, and operates a foot switch to begin the termination cycle. The foot switch in effect controls a cycling operation of reciprocating press 68 so that, upon reaching its lowermost extent, insertion blade 76 inserts wire 18 in the terminal. The insertion force of press 68 is imparted through piston 70 and piston rod 72 to termination blade 76.

The press then automatically raises upper die 66, and accordingly, insertion blade 76 is retracted to its upward position of FIG. 3. Upon elevation of the upper die block, blade 80 is retracted, releasing drive peg 104 and rail 98 for leftward movement in the direction of arrow 52. Connector 10 is thereby indexed to present the next consecutive terminal, that of upper row 12, beneath insertion blade 76.

With reference to FIG. 5, the operator positions another wire 18 above the terminal of the upper row, and operates the foot switch to begin another termination cycle. As far as press 68 is concerned, the cycle of the termination operation is identical to that described above, upper die 66 being displaced a constant distance "x". However, the bottom end of termination blade 76 engages the wire 18, and the upper terminal receiving cavity of the connector housing, prior to the full downward travel of upper die 66. Pressure on the termination blade 76 increases as wire 18 is inserted in the terminal of the upper row cavity.

At this point, downward travel of insertion blade 76 would otherwise continue, destroying the upper row terminal receiving cavity, but for the operation of piston 70, which includes a predetermined pressure relief setting. As pressure imparted by insertion blade 76 to piston 70 increases beyond its set point, air pressure in piston 70 is forced back to the supply along line 110, allowing the piston to collapse, providing substantially free travel to piston rod 72. This allows upper die 66 to continue its full downward deflection of length "z", while allowing insertion blade 76 to travel only a portion of that downward deflection as shown by the dimension DL in FIG. 4 for cavities 16 in the lower row of cavities 14 and by the dimension Du in FIG. 5 for the upper row of cavities 12, thereby limiting the insertion force applied by blade 76 to the connector 10, to a predetermined amount. The pressure release setting of cylinder 70 is infinitely variable over a predetermined range, thereby allowing any desired number of insertion force limit settings for blade 76. Cylinder 70 is of a commercially available type. For example, cylinder 70 can comprise a FABCO PANCAKE model No. C-121.

Thus, it can be seen that the terminator arrangement of the present invention provides a reciprocating press or actuator 68 extensible in the "z" direction with a constant insertion stroke of predetermined length, and a terminating force limit means 70 between press 68 and wire insertion blade 76. Further, the terminating force limit means of piston 70 is automatically responsive to the engagement between insertion blade 76, and upper terminal row 12. Wires 18 can thereby be terminated to the terminals of each row of connector 10, with a predetermined terminating force, but using a single termination stroke of predetemined length "z".

While the indexing arrangement of the present invention has been described with respect to a wire insertion termination station, it is equally advantageous when used with other types of work stations, where the cavities of a housing must be indexed one-at-a-time for presentation to the work station. The connector could, for example, be loaded with crimp-type terminals, presented one-at-a-time to a crimp-type termination station. The indexing arrangement could also be employed in conjunction with a terminal voiding station, where selected terminals are removed from a housing.

I claim:

1. In a machine for the manufacture of electrical cable harness of the type including insulation-clad wire terminated in a connector of the type having a housing with at least two terminal receiving cavities and mating electrical terminals mounted therein, said housing having a series of spaced-apart recesses formed in at least two, parallel, spaced-apart rows extending in a forward direction and staggered with respect to each other in said forward direction, said recesses aligned with said cavities in a predetermined orientation; the improvement comprising:

indexing means for engaging said recesses for indexing said connector in said forward direction to present said cavities of said connector one at a time a work station, said indexing means including at least two, spaced-apart indexing pawls rotatably mounted on a reciprocating drive member movable in said forward direction, each pawl aligned with a respective row of a series of said recesses, said pawls alternately engageable and disengageable with said recesses in said respective rows in response to reciprocating movement of said drive member such that only one pawl is engaged with a recess at any one time whereby said connector is indexed in predetermined amounts in said forward direction to present a succession of cavities to said work station;

said machine further including a reciprocating actuator at said work station extensible on successive strokes of constant predetermined length and at least one wire insertion blade mounted on said actuator to travel successive termination strokes toward connectors in indexed position at said work station to engage and insert a wire in the terminal thereof; and pressure limit means interconnected between said actuator and said insertion blade which is selectively collapsible in response to a predetermined insertion force being applied to a wire during insertion into a terminal of said connector to limit said insertion force to a predetermined amount, whereby said machine automatically inserts wires into a series of terminals in a connector with successive termination strokes of different length equal to or less than said constant length predetermined stroke of said actuator.

2. A machine for the manufacture of electrical cable harnesses in accordance with claim 1, wherein said harnesses include a plurality of discrete insulation-clad conductors, and said connector housing includes at least one upper row and a lowermost row of said terminal-receiving cavities stacked one above the other in a staggered fashion so that the cavities of a lower row are located between the cavities of an upper row, each cavity having an upwardly facing wire receiving slot opening to an upper surface of the housing, and an insulation displacing terminal mounted in each of said cavities;

said reciprocating actuator being extensible a constant predetermined amount on successive strokes when inserting a wire in successive terminals in said upper and lower rows of cavities and wherein said pressure limit means is selectively collapsible in response to a predetermined insertion force being applied to said blade, to limit the insertion force to the same predetermined amount for terminals in both said upper and lower rows.

3. The machine of claim 1, wherein said pressure limit means comprises an air cylinder interposed between said actuator and said wire insertion place for applying pressure to said wire insertion blade, said air cylinder having pressure release means directly proportional to said predetermined insertion force limit.

4. A machine according to claim 1, further comprising:

a mounting plate to which said drive member is secured, said plate slideable in the forward direction of connector movement;

a projection fixed to said mounting plate;

a cam associated with said terminator, said cam operative upon a termination stroke to displace said projection; and said pawls operative upon displacement of said projection to engage a successive upstream recess of said connector, such that upon disengagement of said cam from said projection, one of said pawls indexes said connector in said forward direction.

5. The machine of claim 4 wherein said recesses of each row of said connector are spaced-apart an equal predetermined distance from each other, and said pawls are staggered one-half said predetermined distance, said spacings and staggering all occurring in said forward direction.

* * * * *